US006807931B2

(12) United States Patent
Taylor et al.

(10) Patent No.: US 6,807,931 B2
(45) Date of Patent: Oct. 26, 2004

(54) CONTROL METHOD FOR TRANSITIONS BETWEEN OPEN AND CLOSED LOOP OPERATION IN ELECTRONIC VCT CONTROLS

(76) Inventors: Danny R. Taylor, 32 Upper Creek Rd., Freeville, NY (US) 13068; Earl Ekdahl, 19 Makarainen Rd., Ithaca, NY (US) 14850; Stanley B. Quinn, Jr., 175 Fairlane Ave., Elmhurst, IL (US) 60126

( * ) Notice: Subject to any disclaimer, the term of this patent is extended or adjusted under 35 U.S.C. 154(b) by 0 days.

(21) Appl. No.: 10/408,400

(22) Filed: Apr. 7, 2003

(65) Prior Publication Data

US 2003/0230265 A1 Dec. 18, 2003

Related U.S. Application Data

(60) Provisional application No. 60/389,197, filed on Jun. 17, 2002.

(51) Int. Cl.[7] ..... F01L 1/34

(52) U.S. Cl. ..... 123/90.17; 123/90.15; 123/90.11; 123/90.31; 123/90.16

(58) Field of Search ..... 123/90.17, 12, 123/90.11–90.18, 90.27, 90.31

(56) References Cited

U.S. PATENT DOCUMENTS

| | | | | |
|---|---|---|---|---|
| 5,289,805 A | | 3/1994 | Quinn, Jr. et al. | 123/90.17 |
| 5,826,551 A | * | 10/1998 | Janse van Vuuren | 123/90.12 |
| 6,263,846 B1 | | 7/2001 | Simpson et al. | 123/90.17 |
| 2003/0154965 A1 | * | 8/2003 | Koch | 123/568.41 |

* cited by examiner

*Primary Examiner*—Thomas Denion
*Assistant Examiner*—Kyle M. Riddle
(74) *Attorney, Agent, or Firm*—Brown & Michaels, PC; Greg Dziegielewski

(57) ABSTRACT

In a Variable Cam Timing (VCT) control system, there are conditions when the system must operate in an open-loop mode, and other situations where closed-loop operation is desired. A number of operating states is provided for VCT control system to switch between the states. A control methodology for switching between these two modes of operation, with minimal disturbances, is described. Further, during switching from open loop to closed loop, a scheme that impedes the impact upon the VCT system is provided.

15 Claims, 7 Drawing Sheets

CONTROL METHOD FOR TRANSITIONS BETWEEN OPEN AND CLOSED LOOP OPERATION IN ELECTRONIC VCT CONTROLS

REFERENCE TO RELATED APPLICATIONS

This application claims an invention which was disclosed in Provisional Application No. 60/389,197, filed Jun. 17, 2002, entitled "CONTROL METHOD FOR TRANSITIONS BETWEEN OPEN AND CLOSED LOOP OPERATION IN ELECTRONIC VCT CONTROLS". The benefit under 35 USC §119(*e*) of the United States provisional application is hereby claimed, and the aforementioned application is hereby incorporated herein by reference.

BACKGROUND OF THE INVENTION

1. Field of the Invention

The invention pertains to the field of variable camshaft timing (VCT) systems. More particularly, the invention provides an effective means of performing the switch between operating states, with minimal disturbance to the system.

2. Description of Related Art

It is known to use closed loop control system in a variable cam timing (VCT) control system. In the variable cam timing (VCT) control system, there may be conditions when the controller must switch between open and closed loop operations. However, if this switching is not performed carefully, then a disturbance to the system may occur, resulting in poor system transient performance.

Vane type VCT systems include both "Cam Torque Actuated (CTA) and "Oil Pressure Actuated" (OPA) systems. Both systems generally operate as follows: when the control valve is at the center or "null" position, oil flow in both the "Advance" and the "Retard" chambers is blocked. The control valve at null position hydraulically locks the phaser in its current position. When the control valve is moved away from "null" in one direction, oil is allowed to flow into the "Advance" chamber, advancing the camshaft phase angle. When the control valve is moved away from "null" in the other direction, oil is allowed to flow into the "Retard" chamber, retarding the camshaft phase angle.

U.S. Pat. No. 5,289,805 provides an improved VCT method involving a closed loop feedback control system. The method utilizes a hydraulic PWM spool position control and an advanced control method suitable for use in a computer program product that yields a prescribed set point tracking behavior with a high degree of robustness.

A feedback loop is used when the system parameters are within a suitable range. However, outside the range, the feedback loop may be counter productive with regard to engine control.

Referring now to FIG. 1, a prior art feedback loop 10 is shown. The control objective of feedback loop 10 is to have the VCT phaser at the correct phase (set point 12) and the phaser rate of change reduced to zero. In this state, the spool valve 14 is in its null position and no fluid flows between two fluid holding chambers of a phaser (not shown). A computer program product which utilizes the dynamic state of the VCT mechanism is used to accomplish the above state.

The VCT closed-loop control mechanism is achieved by measuring a camshaft phase shift.$\theta_0$ 16, and comparing the same to the desired set point 12. The VCT mechanism is in turn adjusted so that the phaser achieves a position which is determined by the set point 12. A control law 18 compares the set point 12 to the phase shift $\theta_0$ 16. The compared result is used as a reference to issue commands to a solenoid 20 to position the spool 14. This positioning of spool 14 occurs when the phase error (the difference between set point 12 and measured phase $\theta_0$ (16) is non-zero.

The spool 14 is moved toward a first direction (e.g. right) if the phase error is positive (retard) and to a second direction (e.g. left) if the phase error is negative (advance). When the phase error is zero, the VCT phase equals the set point 12 so the spool 14 is held in the null position such that no fluid flows within the spool valve.

Camshaft and crankshaft measurement pulses in the VCT system are generated by camshaft and crankshaft pulse wheels 22 and 24, respectively. As the crankshaft (not shown) and camshaft (also not shown) rotate, wheels 22, 24 rotate along with them. The wheels 22, 24 possess teeth which can be sensed and measured by sensors according to measurement pulses generated by the sensors. The measurement pulses are detected by camshaft and crankshaft measurement pulse sensors 22*a* and 24*a*, respectively. The sensed pulses are used by a phase measurement device 26. A measurement of the CAM position or phase expressed as $\theta_0$ 16 is then determined. This phase measurement is then supplied to the control law 18 for giving suitable commands to reach the desired spool position.

U.S. Pat. No. 6,263,846 provides hydraulic system for adjusting cam phase. The hydraulic system uses a pair of three way hydraulic valves controllable by a controller to control the flow of liquid to the advance and retard chambers respectively. Further, the need for a spool valve is eliminated. As can be appreciated, the cam phase adjustment in this invention uses oil pressure as an actuating force.

During the operational life of the VCT system, there may be conditions when the controller must switch between open and closed loop operations or modes. Similarly, the switching occurs on the reverse in that the controller must switch from closed loop to open loop modes. The switching causes disruptions, if this switching is not performed carefully, then a disturbance to the system may occur, resulting in poor system transient performance. Therefore, it is desirous to provide a method for switching between the above two modes with minimum disturbance.

SUMMARY OF THE INVENTION

In a variable cam timing control system having conditions as to when the control system must operate in an open or closed loop mode, a method for switching between the above two modes is provided.

In the variable cam timing control system, a method for switching between the above-two modes with minimum disturbance is provided. The method is suitable for vane type variable cam timing systems including cam torque actuated (CTA) and oil pressure actuated (OPA) systems.

Accordingly, in a variable cam timing (VCT) system that has a plurality of states indicating a set of two operational modes of the VCT system, the two operational modes of the VCT system are open loop mode and closed loop mode. The system with the plurality of states includes a first state that is disposed to be transferred to a second state with the transformation based upon a set of conditions. A method is provided comprising the steps of: providing a closed feedback control loop for the VCT system to operate under the closed loop mode. During transferring from the first state to the second state, switching from a closed loop mode to an open loop mode occurs. In the open loop mode, closed feedback control loop is not used; and during transferring from the second state to the first state, switching from the open loop mode to the closed loop mode occurs; and the closed feedback control loop is used.

DETAILED DESCRIPTION OF THE INVENTION

The control method of the invention provides an effective system for performing switches among a plurality of operating states. The switches are performed with minimal disturbance to the system.

Figure 1:
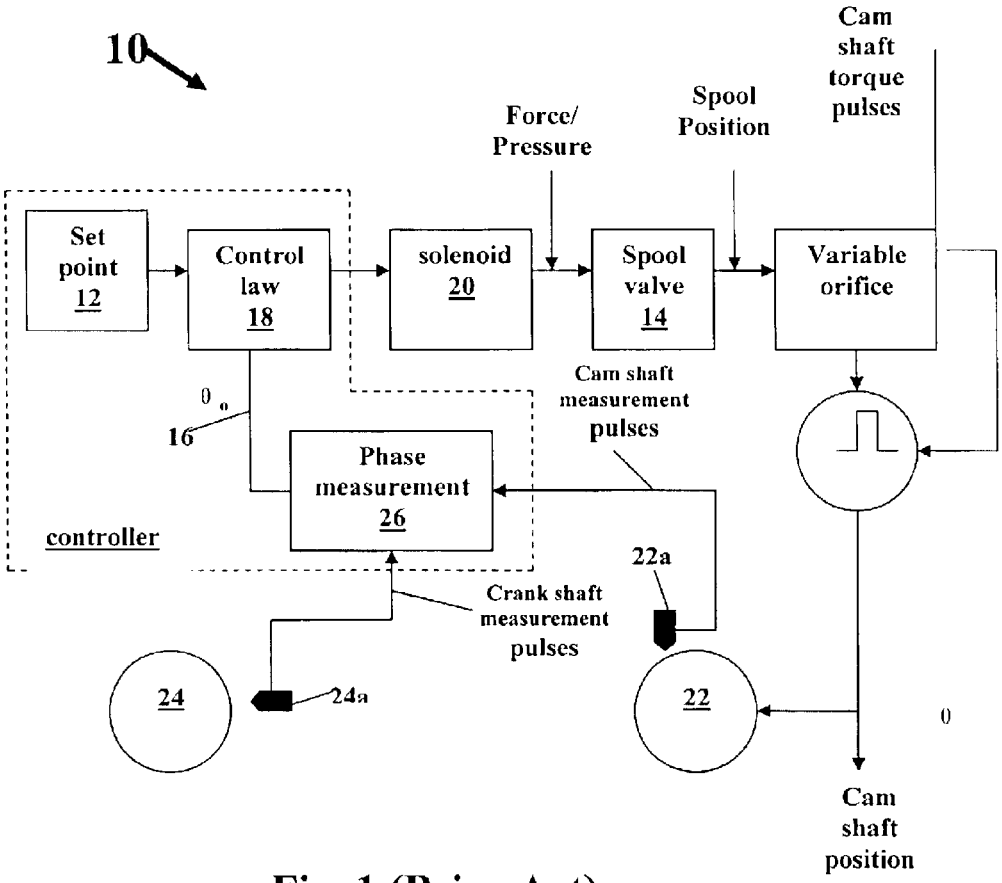
Fig. 1 (Prior Art)
FIG. 1 shows a prior art closed loop feed back control system for a VCT device.
Figure 1A:
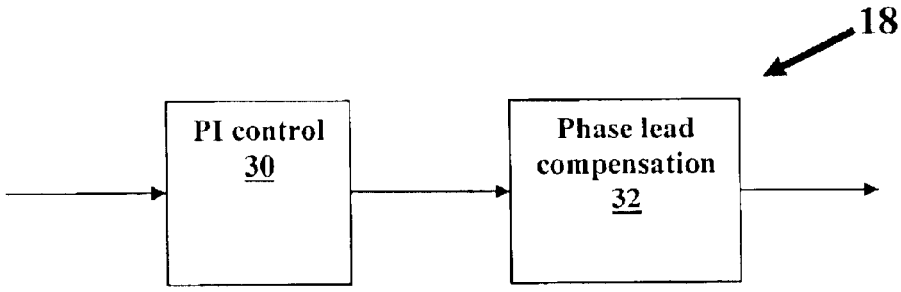
Fig. 1A (Prior Art)
FIG. 1A shows a portion in detail of FIG. 1 prior art closed loop feed back control system for a VCT device.
Figure 2:
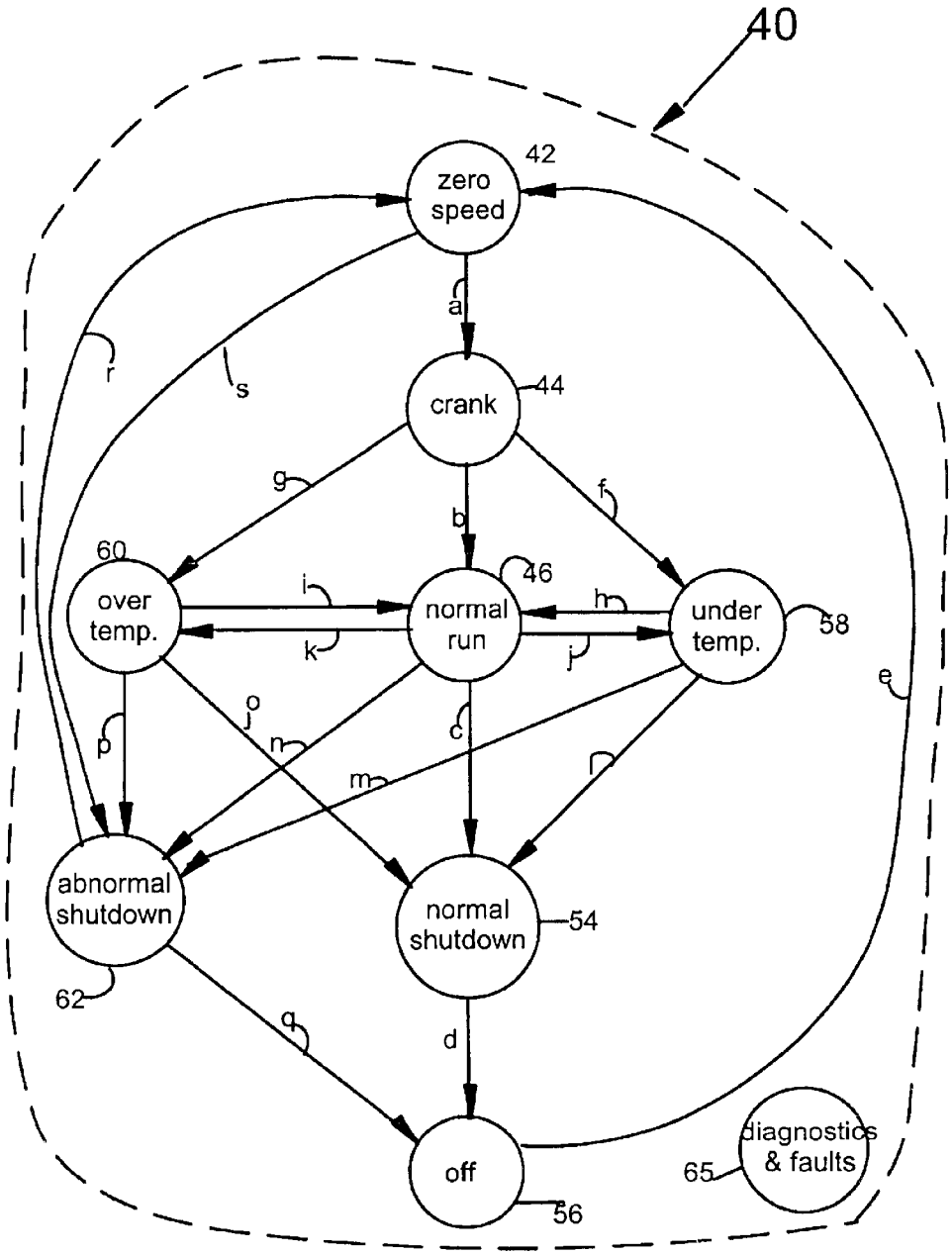
FIG. 2 shows a diagram of the operating states.

Referring to FIG. 2, a diagram 40 of the operating states and their inter-relationships are shown. Generally, a controller such as an engine control unit (ECU) having access to information supplied by sensors controls the switching between states. A detailed description of the operating states is listed infra.

ZERO_SPEED State 42 is in effect when the VCT controller measures a crankshaft speed at zero or its whereabouts. State 42 is the normal state immediately after the ignition key is turned ON. State 42 is also in effect whenever the crankshaft speed is in a range below the minimum speed within which the position sensors cannot operate.

At state 42, all phasers are commanded to operate in the open loop mode, or commanded to their "engine start" positions (e.g. solenoid current to the minimum value). Any active locking devices are commanded to engage thereby fixing an angular relationship among crank shaft and cam shafts which may include a plurality of intake and exhaust cam shafts. As can be appreciated, there can be more than one phaser in a VCT system. For example, each cam shaft corresponds to one phaser. It is noted that the "engine start" position may be at the full advance stop, the full retard stop, or somewhere in between, depending on the camshaft and the application. Further, zero speed state 42 is operating under an open loop mode.

If crank speed is substantially greater than zero, zero speed state 42 is transferred or switched to CRANK state 44, which also operates under open loop mode. In effect when the VCT controller measures a small crankshaft speed, typically less than 300 rpm, state 44 is activated.

At state 44, all phasers are commanded open loop, to their default "engine start" positions (e.g. solenoid current to minimum value). Any active locking devices are commanded to engage. The cam position setpoints are also set to the default "engine start" positions, in anticipation of entry into the NORMAL RUN state 46 which is described infra. This process is the normal way for an engine to transfer from crank state 44 to normal run state 46 during its starting process.

If an ABNORMAL SHUTDOWN occurs at this juncture (e.g., indicated by a flag in non-volatile memory), then state 44 is maintained until all cams reach their default "engine start" positions. When the default positions are reached, the ABNORMAL SHUTDOWN flag is cleared. The ABNORMAL SHUTDOWN state is described infra.

If no abnormal conditions occur, crank state 44 is transferred to normal run state 46. For example, when the condition:

ABNORMAL SHUTDOWN flag clear-AND-Crank>=300-AND-Temp>=20° F.-AND-Temp<=300° F.

is satisfied, crank state 44 is transferred to normal run state 46.

Normal run state 46 is operating under closed loop mode. Closed loop mode goes into effect when crankshaft speed and the temperature (of a fluid such as lubricating oil) are in their respective normal range (e.g., for crankshaft speed greater than 300 rpm). Closed loop is the normal mode of operation for the VCT system including at least one phaser, where the camshaft position is controlled by the closed loop to achieve a desired cam position. The closed loop operation includes having a "Setpoint" received from the engine controller to reach the desired cam position. At the beginning or during normal run state 46, any active locking devices are commanded to disengage, and the solenoid currents are controlled to whatever values are dictated by the closed loop control program product associated with the controller.

Different techniques are used to minimize the disturbances during the transitions from open loop mode into this closed loop mode. One of three methods can be employed, depending on the application: The three methods are using first order filtering (see FIG. 3), using rate control (see FIG. 4), or using a combination of both first order filtering and rate control (see FIG. 5).

Figure 3:
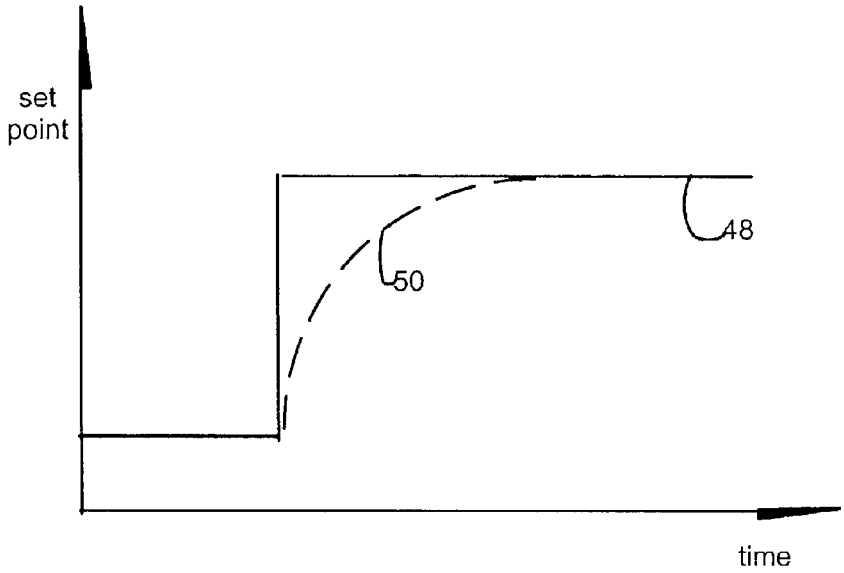
FIG. 3 shows a method of first order filtering in a first embodiment of the invention.

Referring to FIG. 3, a cam position set point with respect to the crank shaft is commanded to change by the controller from a first set point value to a second set point value. In its simplified form, the change is a step change as indicated by graph 48. However, VCT system components generally cannot accommodate very well with the abrupt step change. Therefore, a first order filter is applied thereto, whereby the transition or change is shown by transition curve 50 representing a set of processed set points. It is noted that the first order filter of FIG. 3 may not be necessary for the implementation of the present invention. However, the first order filter enhances or improves the system performance as a whole.

Figure 4:
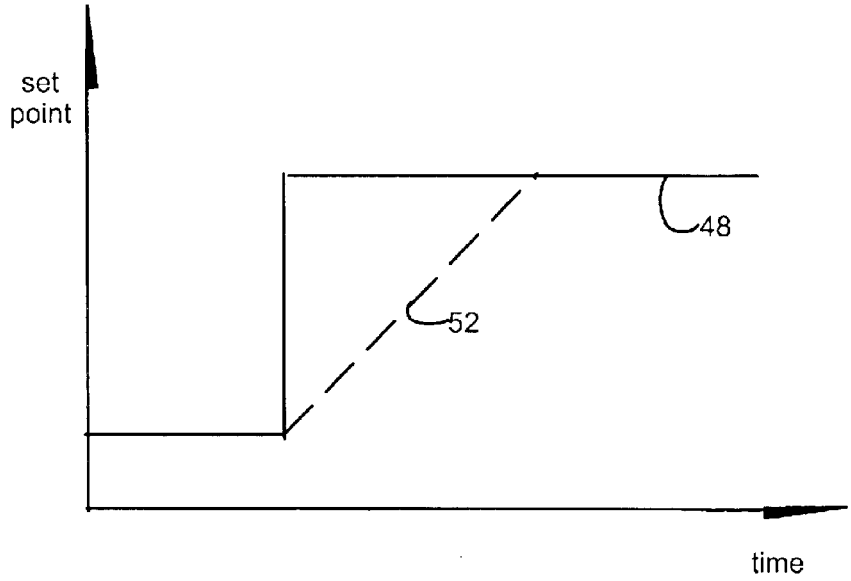
FIG. 4 shows a method of rate control in a second embodiment of the invention.

Referring to FIG. 4, a method similar to FIG. 3 is depicted except that instead of using a first order filter, a rate control method is used. In other words, the controller increases the set point value according to a predetermined rate. In effect, a ramp of sorts depicted by curve 52 impedes some impact on the VCT system. It is noted that the rate control method of FIG. 4 may not be necessary for the implementation of the present invention. However, the rate control method enhances or improves the system performance as a whole.

Figure 5:
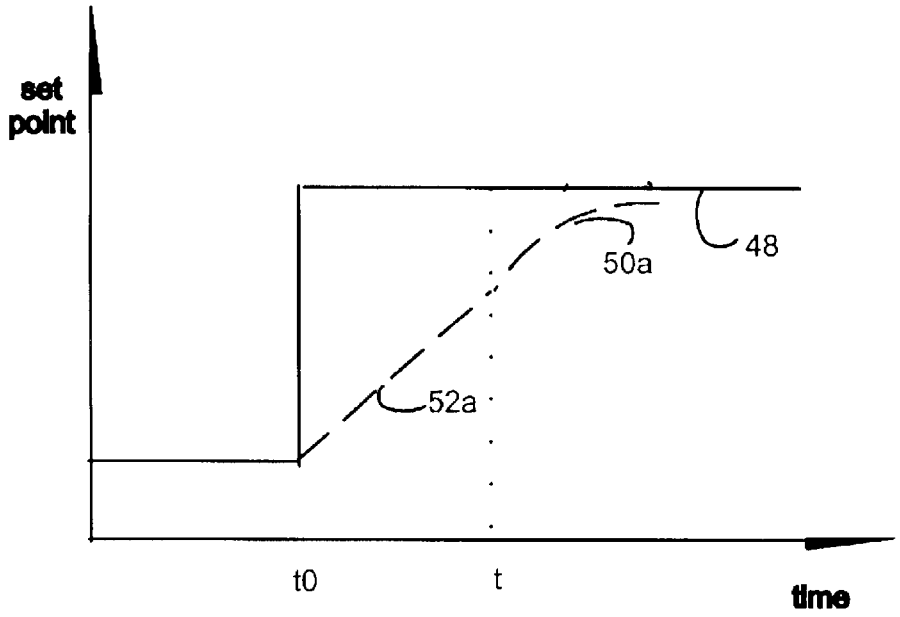
FIG. 5 shows a method which combines first order filtering and rate control in a third embodiment of the invention.

Referring to FIG. 5, a combination of the methods depicted in FIGS. 3 and 4 is described. The transition of set points is sequentially divided into two time segments, a first time segment using rate control as that of FIG. 3 and a second time segment using filter as that of FIG. 4. At the time to the VCT system decides to change set points, the controller start using rate control as indicated by line segment 52*a*. At time point t, rate control method stops and filter method starts thereafter as indicated by line segment 50*a*. The reason for using the filter method after t is that since the rate control method still has more impact upon the VCT system than the filter method in the neighborhood of the stepped up set point level. Thereby the filtering method is preferred over the rate control method in the neighborhood of the set point level.

It is pointed out that prior to entry into the NORMAL RUN state 46, the cam position setpoints are set to the default "engine start" positions. After entry into state 46 which is in a closed loop mode, the setpoints are received from the engine controller commands. The engine controller also determines whatever is appropriate for the current conditions (e.g. engine speed, throttle position, etc.). Typically the engine start position is initially just a few degrees away from the default "engine start" positions. The setpoint filtering described supra (FIG. 3) may be employed to provide a smooth transition from open loop to closed loop states, with little disturbance to the cam position which is shown in FIG. 5.

Referring back to FIG. 2, when ignition key is normally turned "OFF" such as turned off by a vehicle operator, NORMAL_SHUTDOWN state 54 occurs. In the normal shutdown state 54, the ignition key is turned OFF. The mode is changed from closed loop, to open loop, and all phasers are commanded to their default positions (e.g. solenoid current to minimum value). Any active locking devices are commanded to engage.

After a small time delay to allow time for the phasers to reach their default positions (the small time delay is temperature dependent—typically 3 sec.), the VCT controller turns off the regulated power supply. The normal shut down state transfers to "OFF" state 56. It is noted that during this delay, the controller may also store various system parameters into a non-volatile memory.

The transferring between states listed supra is termed "normal" process in that the VCT system is operating without any disturbance as far as the controller is concerned. Other transferrings between states which are listed infra depicts abnormal state transfers. For example, during the "OFF" state 56, if the ignition key is turned on, the system transfers to zero state 42.

Other abnormal states and transferring thereto includes crank state 44 to under temperature state 58 and over temperature state 60 respectively. UNDER_TEMP state 58 operates in the open loop mode. In effect, when the VCT controller measures a temperature below the closed loop operational range (typically less than 20° F.), the present transfer of states occurs.

At state 58, all phasers are commanded to operate in the open loop mode, i.e., to their respective default positions (e.g. solenoid current to minimum value). At this juncture, any active locking devices are commanded to engage. The cam position setpoints are also set to the default positions, to prepare for entry into the NORMAL RUN state 46. By example, if temperature rises above 20° F., system switches to normal state 46.

OVER_TEMP state 60 operate in the open loop mode. In effect, when the VCT controller measures a temperature above the closed loop operational range (typically greater than 300° F.), the transferring into state 60 occurs. During state 60, the loop is being opened or maintaining the open mode if the loop is already opened. At this juncture, all phasers are commanded open loop mode, i.e., to their default positions (e.g., solenoid current at minimum value). Any active locking devices are commanded to engage. The cam position setpoints are also set to their respective default positions, to prepare for entry into the NORMAL RUN state 46 if temperature returns to a normal range. By example, if temperature lowers to less than 300° F., system switches to normal state 46.

ABNORMAL_SHUTDOWN state 62 is maintained or entered, if the crankshaft speed drops below a minimum value (typically <300 rpm), while the ignition key is still turned on. This may occur if a sudden engine stall occurs. At this juncture, the mode is quickly changed from closed loop to open loop, and all phasers are commanded to their default positions (e.g., solenoid current at 0). Further, any active locking devices are commanded to engage. This is required to occur as fast as possible to attempt to move the phasers to the default positions before the engine stalls. By way of an example, the controller may set a flag in a non-volatile memory, to identify this occurrence.

State 62 may be entered through various ways including from states 44, 46, 58, and 60. This may occur when the engine speed falls below a predetermined limit. For example, crank speed <300 rpm. State 62 may be transferred to other states under some conditions. For example, if Ignition Key "ON", system enters zero state 42; and if Ignition Key is "OFF", system enters state 56.

Further, when in states 58 and 60, if the temperature changed to a suitable normal range, typically between 20–30° F., normal shutdown state can be entered therefrom. In addition, at state 56, if the Ignition Key is "ON", state 56 is transferred to state 42.

As can be appreciated, in general the system must operate in the open-loop mode, under the following conditions:

At engine start

At engine shutdown

Whenever the cam phase position can not be measured

Under certain fault conditions

FIG. 2 shows some of the state diagram, which is not all inclusive. The conditions and values shown are for reference only, and may vary depending on the application. To further clarify matter, some of the contemplated states and their interrelated transition conditions are listed below.

Operational States

ZERO_SPEED State (42)

OPEN LOOP—This state is in effect when the VCT controller measures a crankshaft speed of zero. This is the normal state immediately after the ignition key is turned ON. This state will also be in effect whenever the crankshaft speed is below the minimum, which the position sensors can operate.

All phasers are commanded open loop, to their "engine start" positions (solenoid current to the minimum value), and any active locking devices are commanded to engage. Note that the "engine start" position may be at the full advance stop, the full retard stop, or somewhere in between, depending on the camshaft and the application.

Crank (44)

OPEN LOOP—In effect when the VCT controller measures a small crankshaft speed, typically less than 300 rpm.

All phasers are commanded open loop, to their default "engine start" positions (solenoid current to minimum value), and any active locking devices are commanded to engage. The cam position setpoints are also set to the default "engine start" positions, in anticipation of entry into the NORMAL RUN state, once the engine starts.

If an ABNORMAL SHUTDOWN occurred (indicated by a flag in non-volatile memory), then this state is maintained until all cams reach their default "engine start" positions. When they do, the ABNORMAL SHUTDOWN flag is cleared.

NORMAL_RUN (46)

CLOSED LOOP—Goes into effect when the VCT controller measures both a crankshaft speed and the temperature and both are in the normal range (greater than 300 rpm). This is the normal mode of operation for the device, where the camshaft position is controlled closed loop, to a desired cam position "Setpoint" received from the engine controller. Any active locking devices are commanded to disengage, and the solenoid currents are controlled to whatever values are dictated by the closed loop control algorithms.

Figure 6:
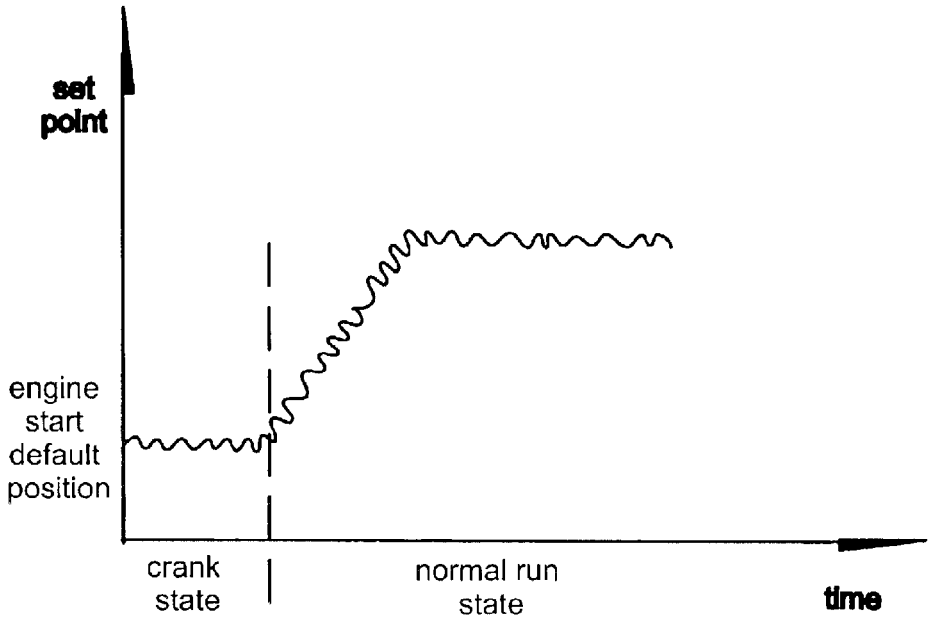
FIG. 6 shows the transition from an open loop mode to the closed loop mode.

Different filtering techniques on the setpoints are used during the transitions to minimize the disturbances during the transitions into this mode. One of three methods is employed, depending on the application: first order filtering (See FIG. 3), rate control (See FIG. 4), or a combination of both (See FIG. 5). Prior to entry into the NORMAL RUN state, the cam position setpoints are set to the default "engine start" positions. After entry into this mode, the setpoints are received from the engine controller, so are whatever is determined appropriate for the current conditions (engine speed, throttle position, etc.). Typically this will initially be just a few degrees away from the default "engine start" positions. The setpoint filtering described above is employed to provide a smooth transition from open loop to closed loop states, with little disturbance to the cam position (See FIG. 6).

UNDER_TEMP (58)

OPEN LOOP—In effect when the VCT controller measures a temperature below the closed loop operational range (typically less than 20° F.).

All phasers are commanded open loop, to their default positions (solenoid current to minimum value), and any active locking devices are commanded to engage. The cam position setpoints are also set to the default positions, to prepare for entry into the NORMAL RUN state.

OVER_TEMP (60)

OPEN LOOP—In effect when the VCT controller measures a temperature above the closed loop operational range (typically greater than 300° F.).

All phasers are commanded open loop, to their default positions (solenoid current to minimum value), and any active locking devices are commanded to engage. The cam position setpoints are also set to the default positions, to prepare for entry into the NORMAL RUN state.

NORMAL_SHUTDOWN (54)

This is the normal shutdown state when the ignition key is turned OFF. The mode is changed from closed loop, to open loop, and all phasers are commanded to their default positions (solenoid current to minimum value), and any active locking devices are commanded to engage.

After a small time delay to allow time for the phasers to reach their default positions (temperature dependent—typically 3 sec.), the VCT controller turns off the regulated power supply, and turns "OFF".

ABNORMAL_SHUTDOWN (62)

This state is entered, if the crankshaft speed drops below a minimum value (typically <300 rpm), while the ignition key is still turned on. This may occur if a sudden engine stall occurs. The mode is quickly changed from closed loop, to open loop, and all phasers are commanded to their default positions (solenoid current at 0), and any active locking devices are commanded to engage. This occurs as fast as possible to attempt to move the phasers to the default positions before the engine stalls, but this might not be possible. A flag is set in non-volatile memory, to identify this occurrence.

Off (56)

The VCT controller is "OFF". This is the state after a shutdown when the ignition key is turned OFF, after the VCT controller turns off the regulated power supply.

Diagnostics and Faults (65)

Activities during this state include several diagnostic and calibration activities. These diagnostic activities occur during states or transition therefrom or thereto including each of the states listed in the present disclosure.

Activities also include "limp home" and other functions to maximize system operation while maintaining safe conditions, during various fault conditions, as detected by the diagnostic activities previously described. The following are some examples which trigger state transitions.

State Transitions a—Crank speed>0 b—ABNORMAL SHUTDOWN flag clear-AND-Crank>=300-AND-Temp>=20° F.-AND-Temp<=300° F.

c—Ignition Key "OFF"

d—Temperature dependent time delay (typically 3 sec.)

e—Ignition Key "ON"

f—ABNORMAL SHUTDOWN flag clear-AND-Crank>300-AND-Temp<20° F.

g—ABNORMAL SHUTDOWN flag clear-AND-Crank>300-AND-Temp>300° F.

h—Temp>=20° F.

i—Temp<=300° F.

j—Temp<20° F.

k—Temp>300° F.

l—Ignition Key "OFF"

m—Crank speed<300 rpm n—Crank speed<300 rpm o—Ignition Key "OFF"

p—Crank speed<300 rpm q—Ignition Key "OFF"

r—Ignition Key "ON"

s—Crank speed<300 rpm

Figure 7:
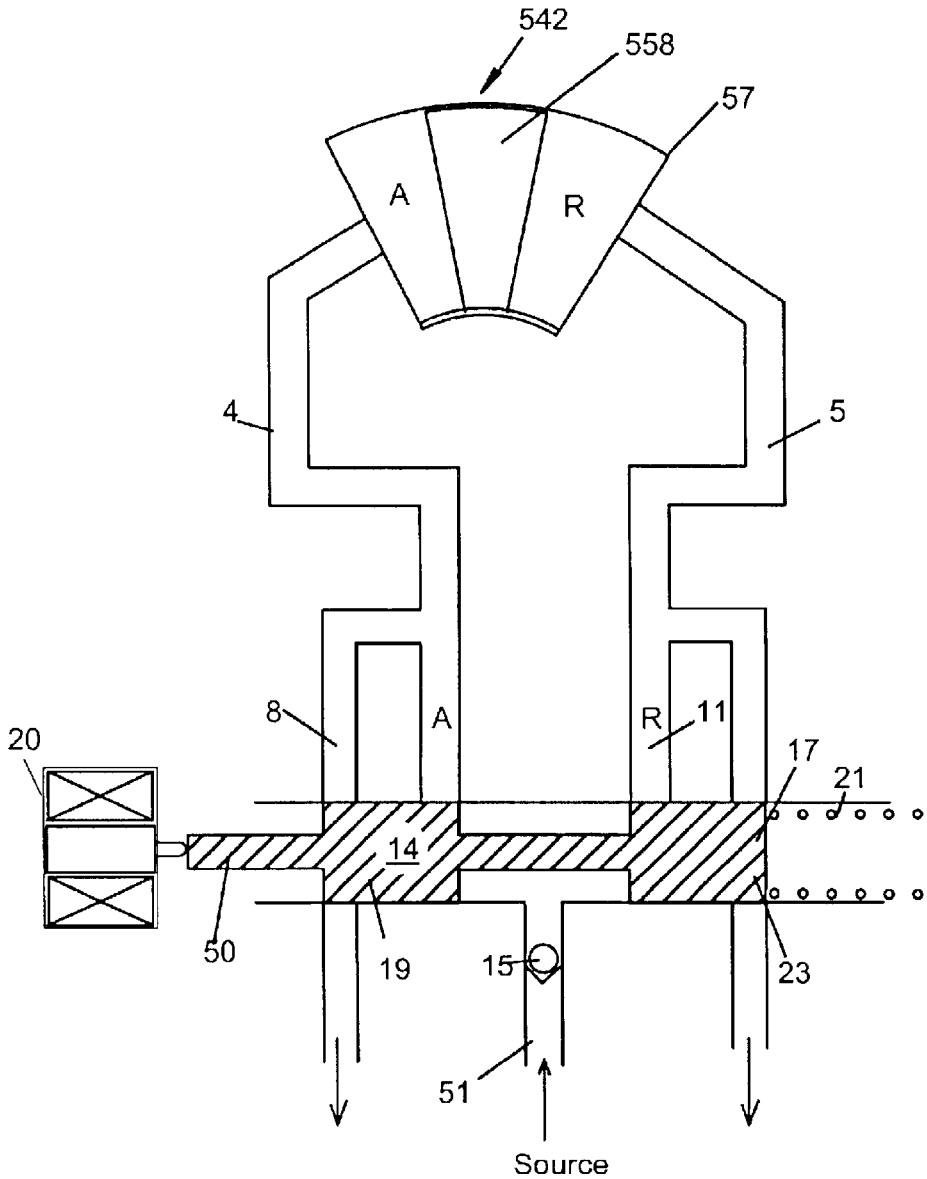
FIG. 7 shows an oil pressure actuated VCT system applicable to the present invention.

FIG. 7 is a schematic depiction that shows, in part, the VCT system of the present invention. A null position is shown in FIG. 7. Solenoid 20 engages spool valve 14 by exerting a first force upon the same on a first end 50. The first force is met by a force of equal strength exerted by spring 21 upon a second end 17 of spool valve 14 thereby maintaining the null position. The spool valve 14 includes a first block 19 and a second block 23 each of which blocks fluid flow respectively.

The phaser 542 includes a vane 558, a housing 57 using the vane 558 to delimit an advance chamber A and a retard chamber R therein. Typically, the housing and the vane 558 are coupled to crank shaft (not shown) and cam shaft (also not shown) respectively. Vane 558 is permitted to move relative to the phaser housing by adjusting the fluid quantity of advance and retard chambers A and R. If it is desirous to move vane 558 toward the retard side, solenoid 20 pushes spool valve 14 further right from the original null position such that liquid in chamber A drains out along duct 4 through duct 8. The fluid further flows or is in fluid communication with an outside sink (not shown) by means of having block 19 sliding further right to allow said fluid communication to occur. Simultaneously, fluid from a source passes through duct 51 and is in one-way fluid communication with duct 11 by means of one-way valve 15, thereby supplying fluid to chamber R via duct 5. This can occur because block 23 moved further right causing the above one-way fluid communication to occur. When the desired vane position is reached, the spool valve is commanded to move back left to its null position, thereby maintaining a new phase relationship of the crank and cam shaft.

Figure 8:
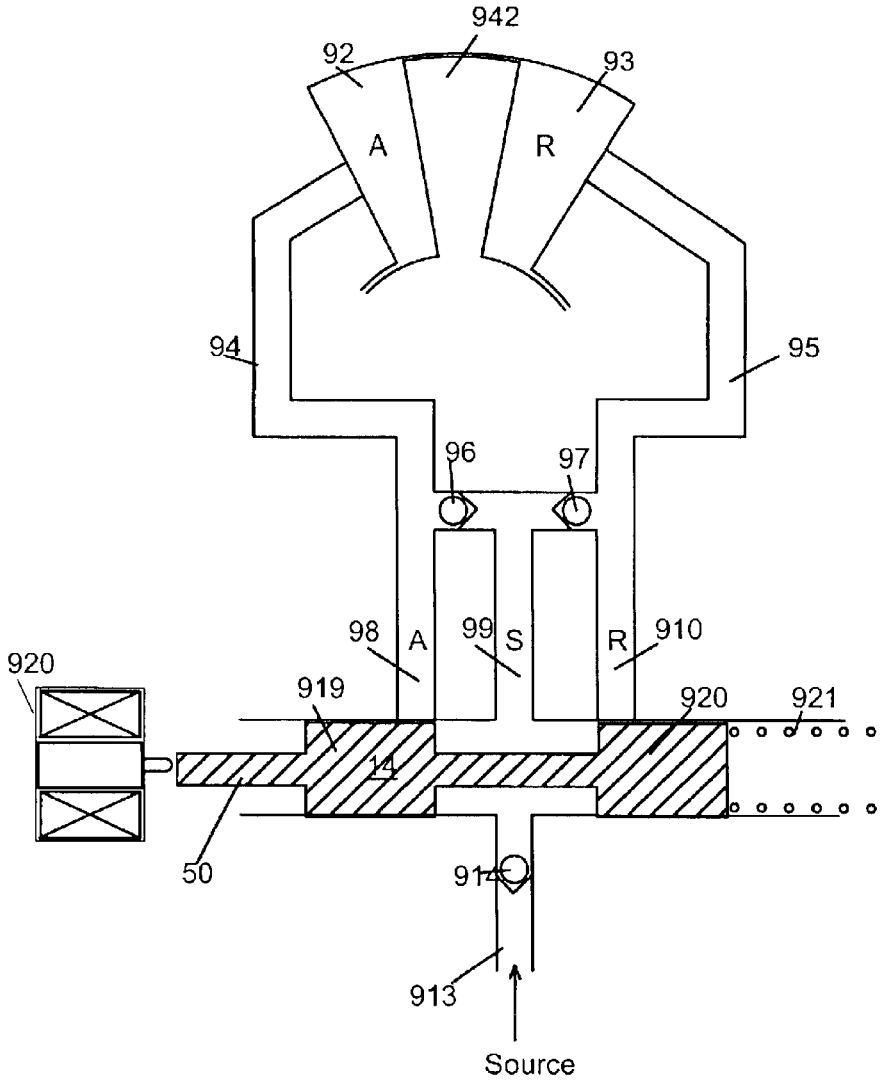
FIG. 8 shows a Cam Torque Actuated (CTA) VCT system applicable to the present invention.

Referring to FIG. 8, a Cam Torque Actuated (CTA) VCT system applicable to the present invention is shown. The CTA system uses torque reversals in camshaft caused by the forces of opening and closing engine valves to move vane 942. The control valve in a CTA system allows fluid flow from advance chamber 92 to retard chamber 93 or vice versa, allowing vane 942 to move, or stops fluid flow, locking vane 942 in position. CTA phaser may also have oil input 913 to make up for losses due to leakage, but does not use engine oil pressure to move phaser.

The detailed operation of CTA phaser system is as follows. FIG. 8 depicts a null position in that ideally no fluid flow occurs because the spool valve 14 stops fluid circulation at both advance end 98 and retard end 910. When cam angular relationship is required to be changed, vane 942 necessarily needs to move. Solenoid 920, which engages spool valve 14, is commanded to move spool 14 away from the null position thereby causing fluid within the CTA circulation to flow. It is pointed out that the CTA circulation ideally uses only local fluid without any fluid coming from source 913. However, during normal operation, some fluid leakage occurs and the fluid deficit needs to be replenished by the source 913 via a one way valve 914. The fluid in this case may be engine oil. The source 913 may be the engine oil pump.

There are two scenarios for the CTA phaser system. First, there is the Advance scenario, wherein an Advance chamber 92 needs to be filled with more fluid than in the null position. In other words, the size or volume of chamber 92 is increased. The advance scenario is accomplished by way of the following.

Solenoid 920, preferably of the pulse width modulation (PWM) type, pushes the spool valve 14 toward right such that the left portion 919 of the spool valve 14 still stops fluid flow at the advance end 98. But simultaneously the right portion 920 moved further right leaving retard portion 910 in fluid communication with duct 99. Because of the inherent torque reversals in camshaft, drained fluid from the retard chamber 93 feeds the same into advance chamber 92 via one-way valve 96 and duct 94.

Similarly, for the second scenario which is the retard scenario wherein a Retard chamber 93 needs to be filled with more fluid than in the null position. In other words, the size or volume of chamber 93 is increased. The retard scenario is accomplished by way of the following.

Solenoid 920, preferably of the pulse width modulation (PWM) type, reduces its engaging force with the spool valve 14 such that an elastic member 921 forces spool 14 to move left. The right portion 920 of the spool valve 14 stops fluid flow at the retard end 910. But simultaneously the left portion 919 moves further left leaving Advance portion 98 in fluid communication with duct 99. Because of the inherent torque reversals in camshaft, drained fluid from the Advance chamber 92 feeds the same into Retard chamber 93 via one-way valve 97 and duct 95.

As can be appreciated, with the CTA cam phaser, the inherent cam torque energy is used as the motive force to re-circulate oil between the chambers 92, 93 in the phaser. This varying cam torque arises from alternately compressing, then releasing, each valve spring, as the camshaft rotates.

The present invention may also be incorporated into a differential pressure control (DPCS) system included in a variable cam timing (VCT) system. The DPCS system includes an ON/OFF solenoid acting upon a fluid such as engine oil to control the position of at least one vane oscillating within a cavity to thereby forming a desired relative position between the a cam shaft and a crank shaft. As can be seen the ON/OFF solenoid of the DPCS system is not of the variable force solenoid type.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA) VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Chamber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is most often located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear).

Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA) or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

One embodiment of the invention is implemented as a program product for use with a computer system. The program(s) of the program product defines functions of the embodiments (including the methods described below with reference to FIG. 2 and can be contained on a variety of signal-bearing media. Illustrative signal-bearing media include, but are not limited to: (i) information permanently stored on in-circuit programmable devices like PROM, EPPOM, etc; (ii) information permanently stored on non-writable storage media (e.g., read-only memory devices within a computer such as CD-ROM disks readable by a CD-ROM drive); (iii) alterable information stored on writable storage media (e.g., floppy disks within a diskette drive or hard-disk drive); (iv) information conveyed to a computer by a communications medium, such as through a computer or telephone network, including wireless communications, or a vehicle controller of an automobile. Some embodiment specifically includes information downloaded from the Internet and other networks. Such signal-bearing media, when carrying computer-readable instructions that direct the functions of the present invention, represent embodiments of the present invention.

In general, the routines executed to implement the embodiments of the invention, whether implemented as part of an operating system or a specific application, component, program, module, object, or sequence of instructions may be referred to herein as a "program". The computer program typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. In a variable cam timing (VCT) system including a plurality of states indicating a set of two operational modes of the VCT system, wherein a plurality of states is provided including a first state disposed to be transferred to a second state based upon a set of conditions, the two operational modes of the VCT system consisting of open loop mode and closed loop mode, a method comprising the steps of:

providing at least one phaser having a rotor and a housing, wherein the rotor is disposed to rotate within the housing;

providing a closed feedback control loop for the VCT system to operate under the closed loop mode;

during transferring from the first state to the second state, switching from a closed loop mode to an open loop mode, wherein the closed feedback control loop is not used; and during transferring from the second state to the first state, switching from the open loop mode to the closed loop mode, wherein the closed feedback control loop is used.

2. The method of claim 1 further comprising the step of maintaining the open loop mode while transferring between states.

3. The method of claim 1, wherein the closed feedback control loop is used when a VCT controller measures a crankshaft speed greater than a predetermined rpm.

4. The method of claim 1, wherein the closed feedback control loop is used when a VCT controller determines the system is operating within a range of temperature.

5. The method of claim 1, wherein during switching from the open loop mode to the closed loop mode, a set point adjustment occurs; a filter is applied on the set point adjustment thereby impeding an impact upon the VCT system.

6. The method of claim 1, wherein during switching from the open loop mode to the closed loop mode, a set point adjustment occurs; a rate control scheme is applied on the set point adjustment thereby impeding an impact upon the VCT system.

7. The method of claim 1, wherein during switching from the open loop mode to the closed loop mode, a set point adjustment occurs; a scheme using a combination of a filter and rate control is applied on the set point adjustment thereby impeding an impact upon the VCT system.

8. The method of claim 1, is controlled by a controller.

9. The method of claim 8, wherein the controller includes an engine control unit.

10. The method of claim 1, wherein the variable cam timing (VCT) system includes a cam torque actuated (CTA) or an oil pressure actuated (OPA) systems.

11. The method of claim 1, wherein the phaser is a vane phaser.

12. In a variable cam timing (VCT) system including at least one phaser having a plurality of states indicating a set of two operational modes of the VCT system, wherein a plurality of states is provided including a first state disposed to be transferred to a second state based upon a set of conditions, the two operational modes of the VCT system consisting of open loop mode and closed loop mode, a method comprising the steps of:

providing a closed feedback control loop for the VCT system to operate under the closed loop mode;

during transferring from the first state to the second state, switching from a closed loop mode to an open loop mode, wherein the closed feedback control loop is not used; and during transferring from the second state to the first state, switching from the open loop mode to the closed loop mode, wherein the closed feedback control loop is used;

wherein the closed feedback control loop is used when a VCT controller determines the system is operating within a range of temperature.

13. In a variable cam timing (VCT) system including at least one phaser having a plurality of states indicating a set of two operational modes of the VCT system, wherein a plurality of states is provided including a first state disposed to be transferred to a second state based upon a set of conditions, the two operational modes of the VCT system consisting of open loop mode and closed loop mode, a method comprising the steps of:

providing a closed feedback control loop for the VCT system to operate under the closed loop mode;

during transferring from the first state to the second state, switching from a closed loop mode to an open loop mode, wherein the closed feedback control loop is not used; and during transferring from the second state to the first state, switching from the open loop mode to the closed loop mode, wherein the closed feedback control loop is used;

wherein during switching from the open loop mode to the closed loop mode, a set point adjustment occurs; a filter is applied on the set point adjustment thereby impeding an impact upon the VCT system.

14. In a variable cam timing (VCT) system including at least one phaser having a plurality of states indicating a set of two operational modes of the VCT system, wherein a plurality of states is provided including a first state disposed to be transferred to a second state based upon a set of conditions, the two operational modes of the VCT system consisting of open loop mode and closed loop mode, a method comprising the steps of:

providing a closed feedback control loop for the VCT system to operate under the closed loop mode;

during transferring from the first state to the second state, switching from a closed loop mode to an open loop mode, wherein the closed feedback control loop is not used; and during transferring from the second state to the first state, switching from the open loop mode to the closed loop mode, wherein the closed feedback control loop is used;

wherein during switching from the open loop mode to the closed loop mode, a set point adjustment occurs; a rate control scheme is applied on the set point adjustment thereby impeding an impact upon the VCT system.

15. In a variable cam timing (VCT) system including at least one phaser having a plurality of states indicating a set of two operational modes of the VCT system, wherein a plurality of states is provided including a first state disposed to be transferred to a second state based upon a set of conditions, the two operational modes of the VCT system consisting of open loop mode and closed loop mode, a method comprising the steps of:

providing a closed feedback control loop for the VCT system to operate under the closed loop mode;

during transferring from the first state to the second state, switching from a closed loop mode to an open loop mode, wherein the closed feedback control loop is not used; and during transferring from the second state to the first state, switching from the open loop mode to the closed loop mode, wherein the closed feedback control loop is used;

wherein during switching from the open loop mode to the closed loop mode, a set point adjustment occurs; a scheme using a combination of a filter and rate control is applied on the set point adjustment thereby impeding an impact upon the VCT system.

* * * * *

UNITED STATES PATENT AND TRADEMARK OFFICE

CERTIFICATE OF CORRECTION

PATENT NO. : 6,807,931 B2
DATED : October 26, 2004
INVENTOR(S) : Taylor et al.

It is certified that error appears in the above-identified patent and that said Letters Patent is hereby corrected as shown below:

Title page,
Item [73], Assignee, should read:
-- [73] Assignee: BorgWarner Inc., Auburn Hills, MI (US) --

Signed and Sealed this

Twenty-second Day of February, 2005

JON W. DUDAS
*Director of the United States Patent and Trademark Office*